US008344990B2

(12) United States Patent
Chen et al.

(10) Patent No.: US 8,344,990 B2
(45) Date of Patent: Jan. 1, 2013

(54) DISPLAY PANEL WITH HALF SOURCE DRIVER STRUCTURE AND DISPLAY DATA SUPPLYING METHOD THEREOF

(75) Inventors: Ken-Ming Chen, Hsin-Chu (TW); Chi-Mao Hung, Hsin-Chu (TW); Chao-Liang Lu, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 450 days.

(21) Appl. No.: 12/491,262

(22) Filed: Jun. 25, 2009

(65) Prior Publication Data

US 2010/0110046 A1 May 6, 2010

(30) Foreign Application Priority Data

Nov. 5, 2008 (TW) ..... 97142709 A

(51) Int. Cl.
*G09G 3/36* (2006.01)

(52) U.S. Cl. ..... 345/100; 345/88; 345/96; 345/98; 345/104; 345/206; 345/209; 349/84; 349/147; 349/140

(58) Field of Classification Search ..... 313/349; 345/84–88, 96, 104, 204, 209, 100, 206; 349/37, 47, 84, 139, 147, 149
See application file for complete search history.

(56) References Cited

U.S. PATENT DOCUMENTS

2004/0257322 A1 12/2004 Moon
2005/0264744 A1* 12/2005 Kim et al. ..... 349/141
2006/0164350 A1* 7/2006 Kim et al. ..... 345/87
2006/0203172 A1 9/2006 Baek et al.

FOREIGN PATENT DOCUMENTS

CN 1808250 7/2006

* cited by examiner

*Primary Examiner* — Lun-Yi Lao
*Assistant Examiner* — MD Saiful A Siddiqui
(74) *Attorney, Agent, or Firm* — WPAT PC; Justin King

(57) ABSTRACT

A display panel with half source driver structure and a display data supplying method thereof are disclosed. The display panel includes a plurality of gate driving circuits, a data line, a plurality of first gate lines and second gate lines, a plurality of first pixels and second pixels. The first pixels are arranged along the data line and form two columns. The first pixels are disposed at one side of the data line and electrically coupled to the respective first gate lines. The second pixels are arranged along the data line and form two columns. The second pixels are disposed at an opposite side of the data lines and electrically coupled to the respective second gate lines. The data line has a bending portion between each two sequentially connected first pixels. The gate driving circuits are electrically coupled to the first gate lines and the second gate lines.

12 Claims, 7 Drawing Sheets

DISPLAY PANEL WITH HALF SOURCE DRIVER STRUCTURE AND DISPLAY DATA SUPPLYING METHOD THEREOF

CROSS-REFERENCE TO RELATED APPLICATION

This application claims the priority benefit of Taiwan application serial no. 097142709, filed on Nov. 5, 2008. The entirety of the above-mentioned patent application is hereby incorporated by reference herein and made a part of specification.

BACKGROUND

1. Technical Field

The present invention generally relates to the field of flat panel display and, particularly, to a display panel with half source driver (HSD) structure and a display data supplying method thereof.

2. Description of the Related Art

Flat panel display devices such as liquid crystal displays (LCDs) and plasma displays have the advantages of high image quality, small size, light weight and widely application, and thus are popularly applied to the consumer electronic products, such as mobile phones, notebooks, desktop display and television, and have gradually replaced the traditional cathode ray tube (CRT) display as the main trend in the display industry.

Referring to FIG. 1, showing a conventional display panel 10 with half source driver (HSD) structure. The display panel 10 includes two gate on array (GOA) circuits 11, 13, a plurality of data lines S1~S4, a plurality of first gate lines G1, G3, G5 and G7, a plurality of second gate lines G2, G4, G6 and G8, a plurality of first pixels 122 and a plurality of second pixels 124. Each of the data lines S1~S4 is for receiving a plurality of display data and for transmitting the display data to the first and second pixels 122, 124 electrically coupled thereto. The first and second pixels 122, 124 electrically coupled to the data lines S1~S4 respectively are disposed at two opposite sides of each data line. The first gate lines G1, G3, G5 and G7 are for, in turn, transmitting a first gate driving signal generated from the GOA circuit 11 to enable the first pixels 122 to receive the display data from the data lines S1~S4. The second gate lines G2, G4, G6 and G8 are for, in turn, transmitting a second gate driving signal generated from the GOA circuit 13 to enable the second pixels 124 to receive the display data from the data lines S1~S4. The first pixels 122 and the second pixels 124 arranged in the same pixel row are the pixels for displaying the same color (e.g., red, green or blue).

Referring to FIG. 2, showing timing diagrams of multiple signals of the display panel 10. In particular, timing diagrams of a data-loading signal (LD), a display data signal (source OP data), a polarity signal (POL) and a vertical start pulse signal (VSTL) in an Nth frame and an (N+1)th frame are illustrated in FIG. 2.

It is found from FIGS. 1 and 2 that a data inversion used in the display panel 10 is dot inversion. The polarity of each of the data lines S1~S4 is inversed at each line period of every frame image, resulting in the power consumption of the data lines S1~S4 is relatively high.

BRIEF SUMMARY

The present invention relates to a display panel with half source driver structure, a data inversion used in the display panel being column inversion so that the power consumption of data lines thereof can be greatly reduced.

The present invention further relates to a display data supplying method of a display panel with half source driver structure, so that the power consumption of data lines of the display panel can be reduced.

In order to achieve the above-mentioned advantages, a display panel with half source driver structure, in accordance with a first embodiment of the present invention, is provided. The display panel includes a plurality of gate driving circuits, a data line, a plurality of first gate lines, a plurality of second gate lines, a plurality of first pixels and a plurality of second pixels. The gate driving circuits are disposed on the display panel. The data line is for receiving and transmitting a plurality of display data. The first gate lines are for transmitting a first gate driving signal in turn. The second gate lines are for transmitting a second gate driving signal in turn. The first pixels are arranged along the data line and form two columns. The first pixels are disposed at one side of the data line and electrically coupled to the respective first gate lines. The second pixels are arranged along the data line and form two columns. The second pixels are disposed at the other side of the data line relative to the first pixels and electrically coupled to the respective second gate lines. The data line has a bending portion between each two sequentially connected first pixels. A part of the gate driving circuits is/are electrically coupled to the first gate lines and disposed at one side of the data line, the other part of gate driving circuits is/are electrically coupled to the second gate lines and disposed at an opposite side of the data line.

A display data supplying method of the display panel of the above-mentioned first embodiment is provided. The display data supplying method includes: providing a plurality of the display data with the same polarity in every frame; transmitting the first gate driving signal and the second gate driving signal; and transmitting the display data with said the same polarity to one of the first pixels and/or one of the second pixels in turn.

Another display panel with half source driver structure, in accordance with a second embodiment of the present invention, is provided. The display panel includes a plurality of gate driver chips, a data line, a plurality of first gate lines, a plurality of second gate lines, a plurality of first pixels and a plurality of second pixels. The gate driver chips are disposed on the display panel. The data line is for receiving and transmitting a plurality of display data. The first gate lines are for transmitting a first gate driving signal in turn. The second gate lines are substantially parallel to the first gate lines and for transmitting a second gate driving signal in turn. The first pixels are disposed at one side of the data line and alternately arranged in two columns. Each of the first pixels is electrically coupled to one of the first gate lines. The second pixels are disposed at a different side of the data lines relative to the first pixels. Each of the second pixels is electrically coupled to one of the second gate lines. The first pixels are arranged in the two columns to form two lines intersecting the first gate lines with a particular angle. A part of the gate driver chips is/are electrically coupled to the first gate lines and disposed at one side of the data line. The other part of the gate driver chips is/are electrically coupled to the second gate lines and disposed at an opposite side of the data line.

A display data supplying method of the display panel of the above-mentioned second embodiment is provided. The display data supplying method includes: providing a plurality of the display data with the same polarity in each frame; transmitting the first driving gate signal and the second driving gate signal; and transmitting the display data with said the same polarity to the first pixels and the second pixels.

In the above-mentioned embodiments of the present invention, owing to the particular pixels and data line layouts, the dot inversion used in the prior art can be replaced by column inversion and an image display of the display panel in accordance with the present invention can be the same as that of the display panel with the dot inversion in the prior art. Furthermore, for the present display panel with column inversion, the polarity of the data line inversed once in every frame, compared with the prior art that the polarity of the data line is inversed in each line period of every frame, namely, inversed as the amount of the data lines in the display in every frame, the power consumption of the data line is greatly reduced.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "left," "right," "row" "column" etc., is used with reference to the orientation of the Figure(s) being described. The components of the present invention can be positioned in a number of different orientations. As such, the directional terminology is used for purposes of illustration and is in no way limiting.

Figure 3:
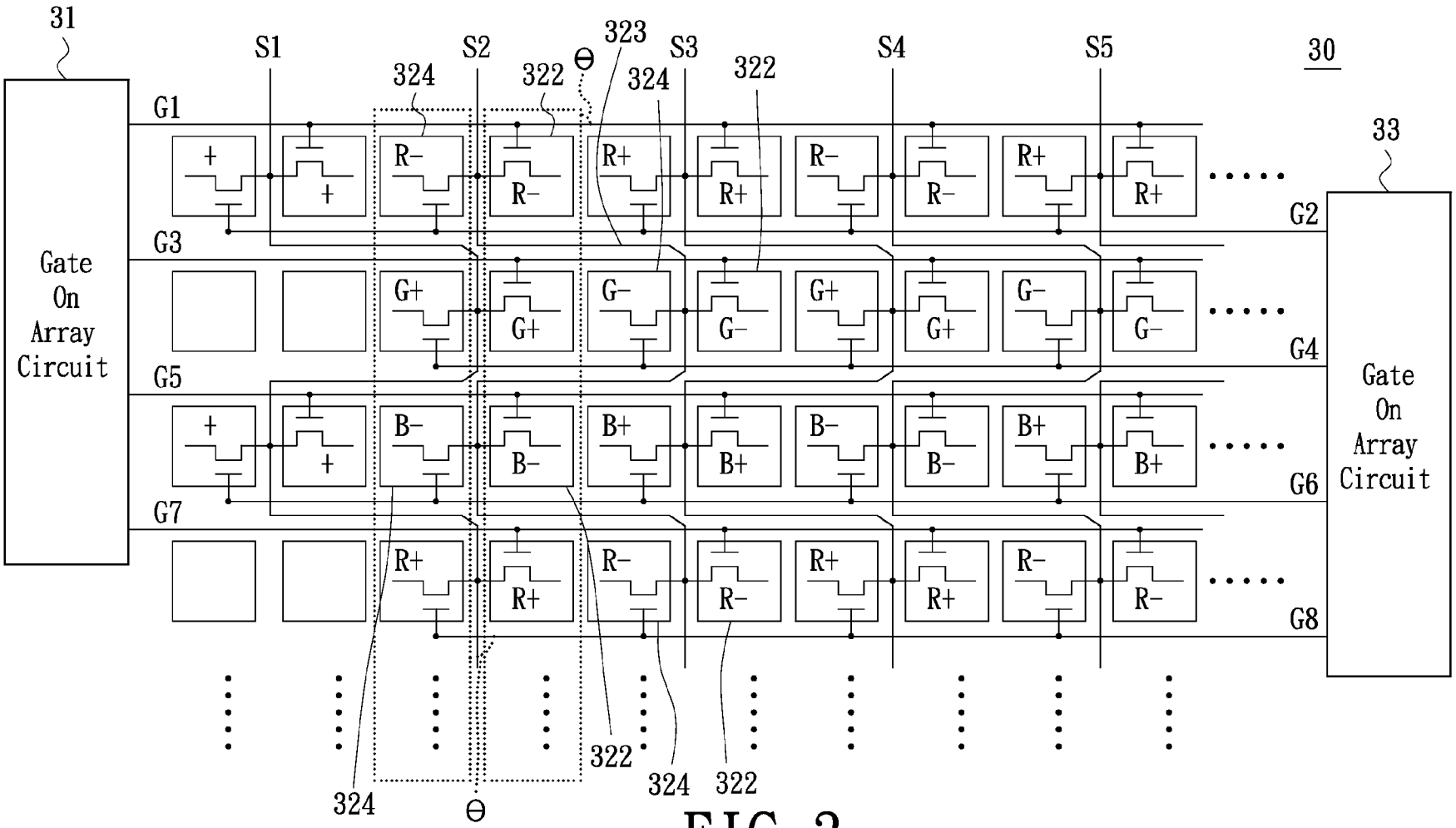
FIG. 3 is a schematic view of a display panel with half source driver structure, in accordance with an embodiment of the present invention.

Referring to FIG. 3, showing a display panel 30 with half source driver structure in accordance with an embodiment of the present invention. The display panel 30 includes two gate driving circuits 31, 33, a plurality of (i.e., two or more) data lines S1~S5, a plurality of first gate lines G1, G3, G5 and G7, a plurality of second gate lines G2, G4, G6 and G8, a plurality of first pixels 322 and a plurality of second pixels 324.

The gate driving circuits 31, 33 are formed on the display panel 30 in gate on array (GOA) manner and respectively disposed at two opposite sides of the data lines S1~S5. In other words, the gate driving circuits 31, 33 are gate on array circuits. The gate driving circuit 31 is for generating a first gate driving signal and electrically coupled with the first gate lines G1, G3, G5 and G7. The gate driving circuit 33 is for generating a second gate driving signal and electrically coupled with the second gate lines G2, G4, G6 and G8. It is indicated that the amount of the gate driving circuits 31, 33 is not limited to two, and can be increased according to the size of the display panel 30 as required in practical applications. Furthermore, in another embodiment, the gate driving circuits 31, 33 can be two gate driver chips disposed on the display panel 30 instead.

Each of the data lines S1~S5 is for receiving a plurality of display data and transmitting the display data to the first and second pixels 322, 324 electrically coupled thereto. The first pixels 322 and the second pixels 324 electrically coupled to any one of the data lines S1~S5 are disposed at two opposite sides of the data line. The first gate lines G1, G3, G5 and G7 are for transmitting the first gate driving signal in turn. The second gate lines G2, G4, G6 and G8 are substantially parallel to the first gate lines G1, G3, G5 and G7 and for transmitting the second gate driving signal in turn.

The first pixels 322 electrically coupled to a same data line (i.e., any one of the data lines S1~S5 in the present embodiment) are arranged along the data line and alternately formed in two columns. Furthermore, as seen from FIG. 3, the first pixels 322 electrically coupled to the same data line are arranged in the two columns to form two lines (as denoted by the dashed rectangle in FIG. 3) intersecting the first gate lines G1, G3, G5 and G7 with a particular angle θ, and the particular angle is about 90 degrees. Each of the lines has a width equal to a width of the first pixels 322. Likewise, the second pixels 324 electrically coupled to a same data line are arranged in two columns to form two lines (as denoted by the dashed rectangle in FIG. 3) intersecting the second gate lines G2, G4, G6 and G8 with a particular angle θ, the particular angle θ is about 90 degrees and each of the lines has a width equal to a width of the second pixels 324. In the present embodiment, since each two adjacent first pixels 322 (or second pixels 322) electrically coupled to a same data line are arranged in two columns, each of the data lines S1~S5 has a bending portion 323 between each two sequentially connected first pixels 322 (or second pixels 324). The bending portion 323 can contain one bend or a combination of multiple bends.

Still referring to FIG. 3, the RGB pixels in the display panel 30 are arranged in strip form. The first pixels 322 (or second pixels 324) arranged in the same pixel row are the pixels displaying the same color, e.g., red, blue or green, and the first pixels 322 (or second pixels 324) electrically coupled to the same data line are pixels for display different colors. The first pixels 322 and the second pixel 324 are arranged to form a plurality of pixel rows (e.g., four pixel rows in the present embodiment), each of the pixel rows has two dummy pixels (referring to the pixels not labeled with R, G or B in each pixel row) disposed at the head or tail thereof.

Figure 1:
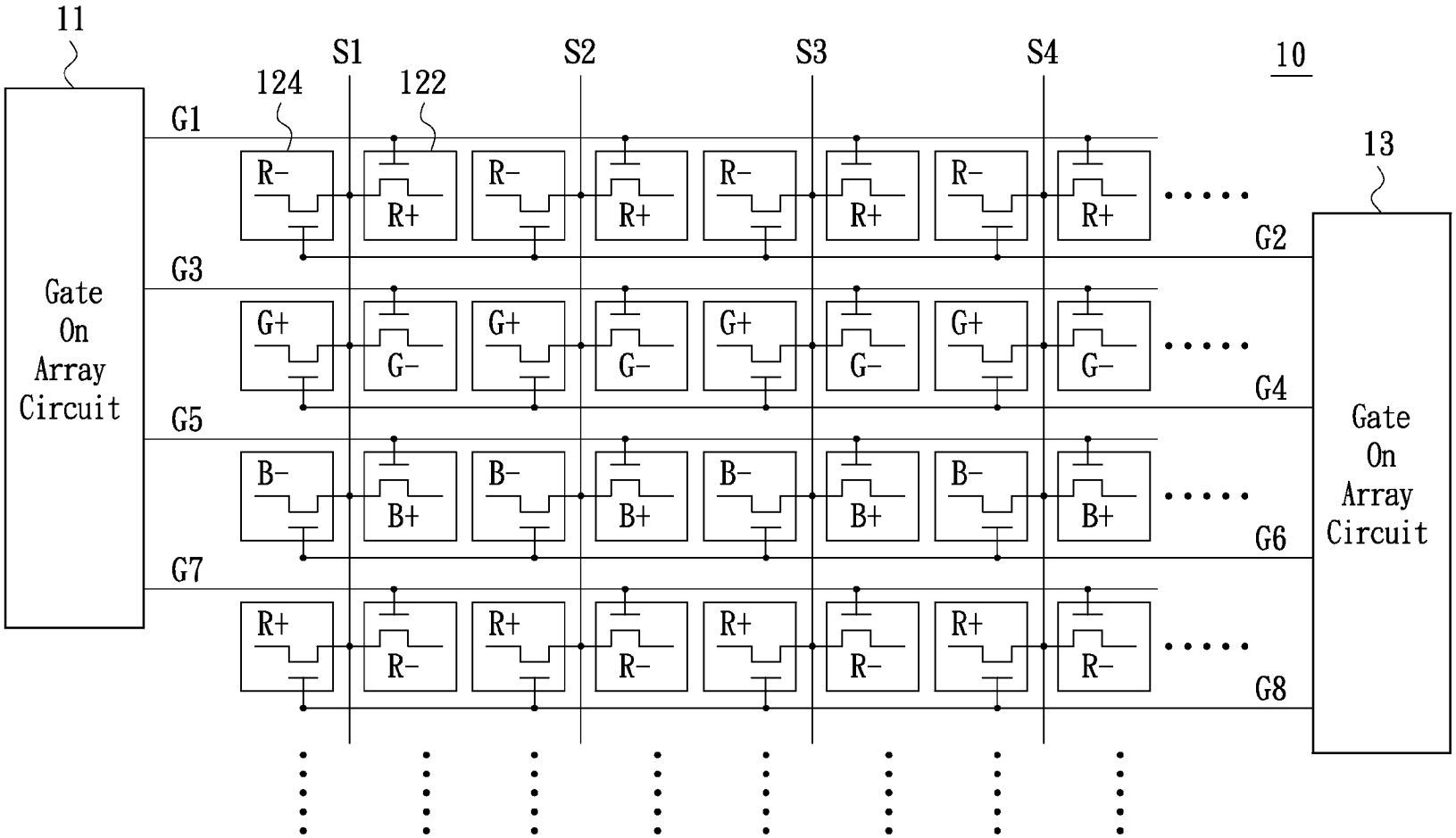
FIG. 1 (Prior Art)
FIG. 1 is schematic view of a conventional display panel with half source driver structure.
Figure 2:
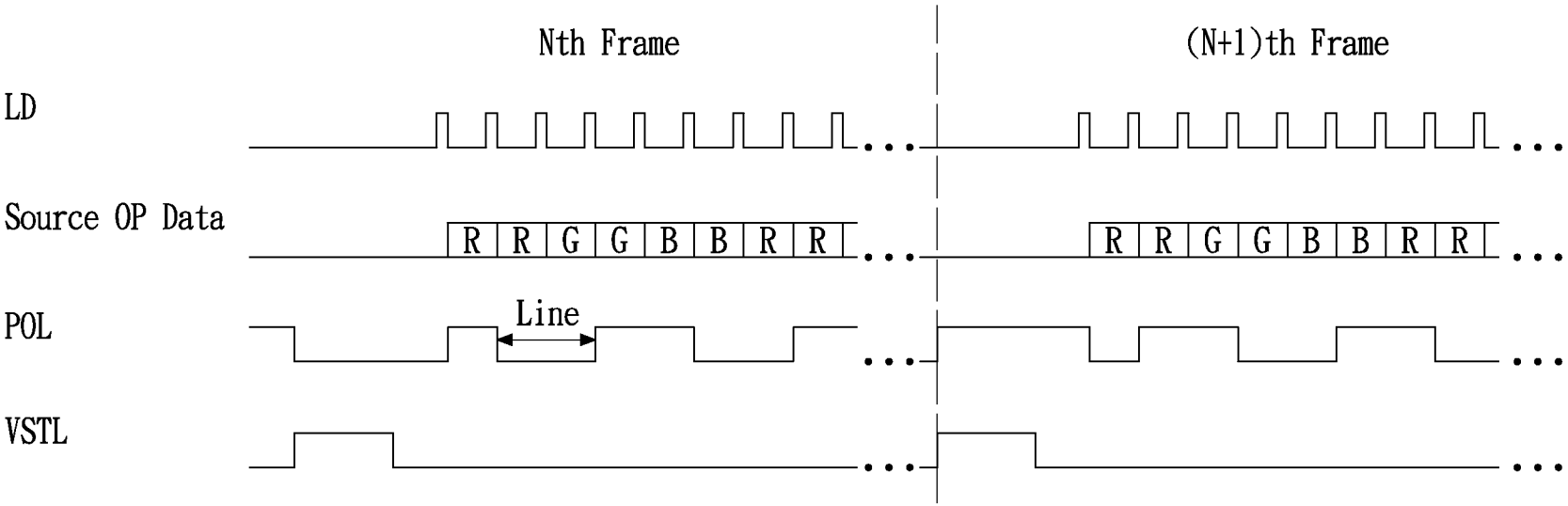
FIG. 2 (Prior Art)
FIG. 2 shows timing diagrams of multiple signals of the display panel of FIG. 1.
Figure 4:
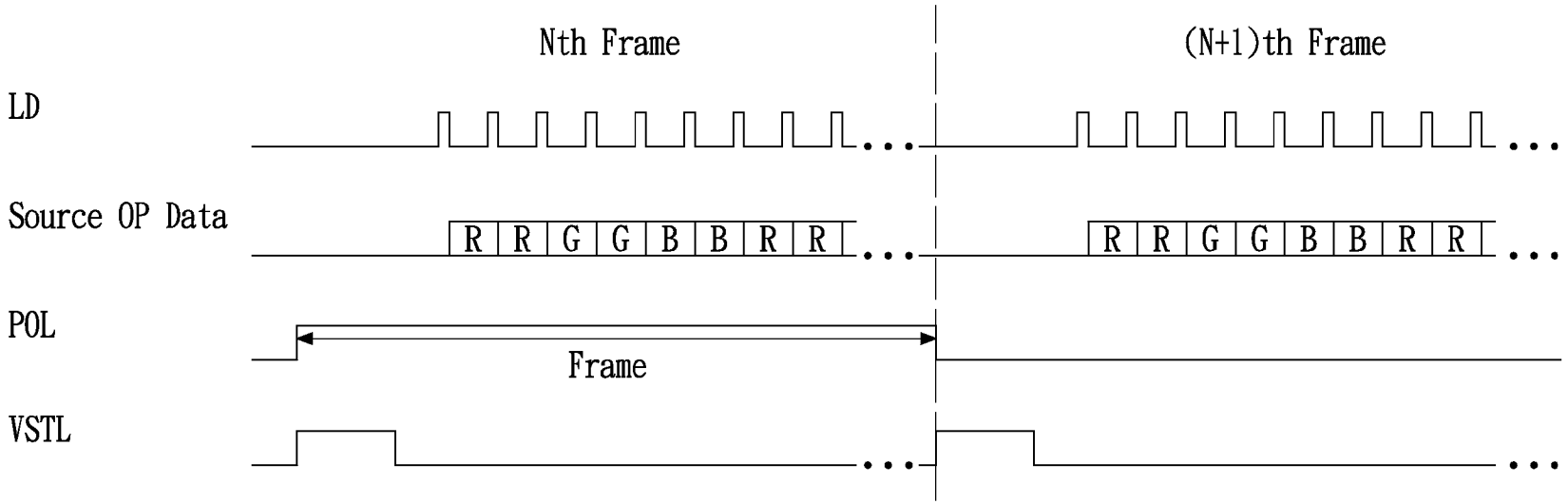
FIG. 4 shows timing diagrams of multiple signals of the display panel of FIG. 3.

Referring to FIG. 4, showing timing diagrams of multiple signals of the display panel 30. In particular, FIG. 4 shows timing diagrams of a data-loading signal (LD), a display data signal (source OP data), a polarity signal (POL) and a vertical start pulse signal (VSTL) in an Nth frame and an (N+1)th frame. It is found from FIGS. 3 and 4 that a data inversion used in the display panel 30 is column inversion, the polarity of each of the data lines S1~S5 only is inversed one time in every frame image. In addition, comparing FIG. 3 with FIG. 1, it can be seen that since the present embodiment employs a particular layouts of the pixels and the data lines S1~S5, an image display effect of the display panel 30 with column inversion as illustrated in FIG. 3 can be the same as the image display effect of the display 10 with dot inversion as illustrated in FIG. 1 and further the use of the column inversion in the display panel 30 greatly reduces the power consumption of the data lines S1~S5.

A display data supplying method of the display panel 30 with half source driver structure will be described below in detailed with reference to accompanying FIGS. 3 and 4. The display data supplying data includes the steps of: proving a plurality of display data having positive polarity (or negative polarity) in a Nth (or (N+1)th) frame; transmitting the first gate driving signal and the second gate driving signal respectively generated from the gate driving circuits 31 and 33; and transmitting the display data with the same polarity (e.g., positive polarity in Nth frame or negative polarity in (N+1)th frame), in turn, to the one of the first pixels 322 and one of the second pixels 324. Furthermore, in each two adjacent frames, a plurality of display data with different polarities are provided, e.g., the display data with positive polarity are provided in the Nth frame and the display data with negative polarity are provided in the (N+1)th frame.

Figure 5:
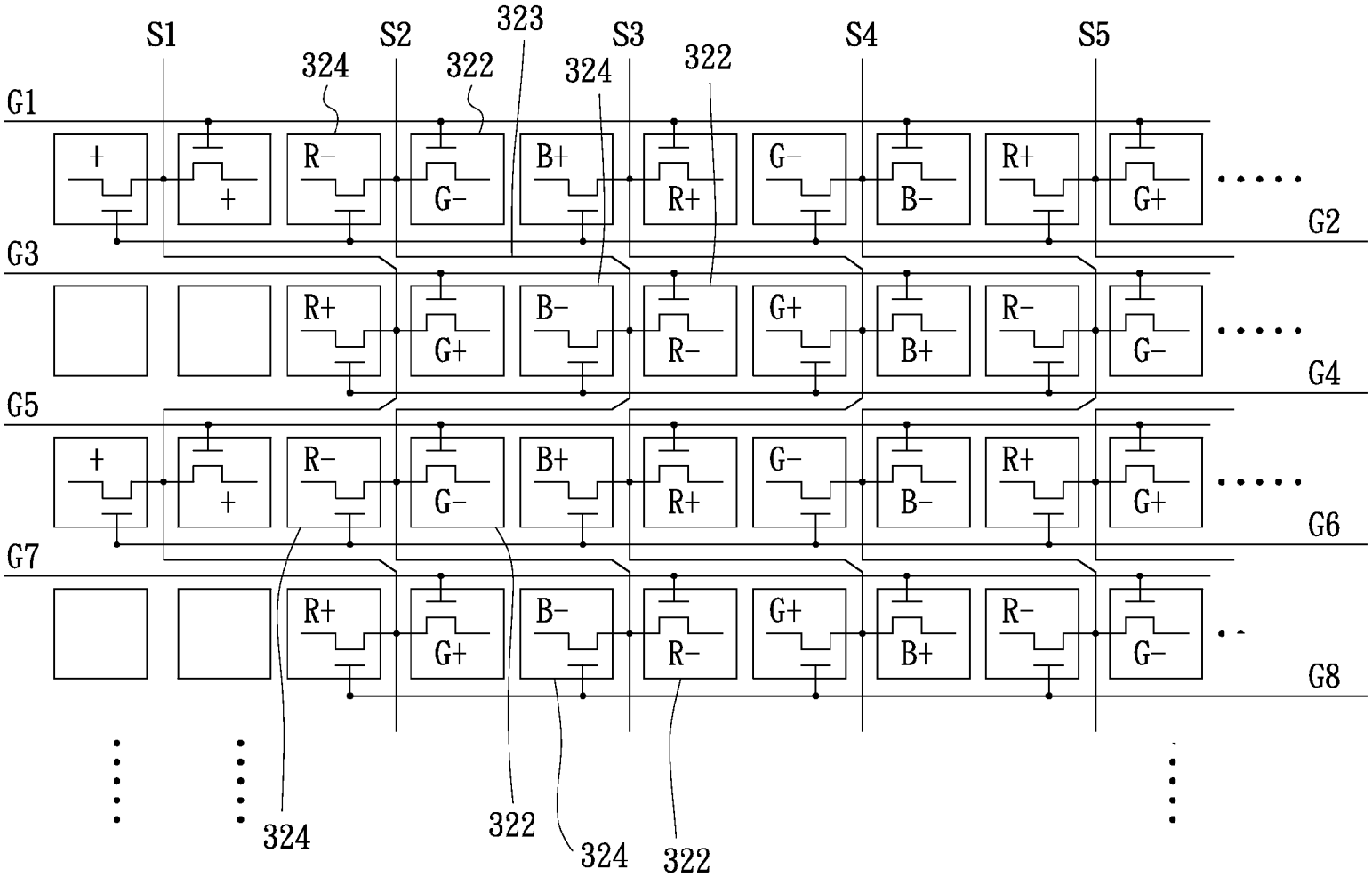
FIG. 5 is a schematic view of a display panel with half source driver structure, in accordance with another embodiment of the present invention.

It is indicated that the strip arranged RGB pixels in the display panel 30 are not limited to that the first pixels 322 (or second pixels 324) in a same pixel row are the pixels for display a same color, as illustrated in FIG. 4. As shown in FIG. 5, the first pixels 322 (or second pixels 324) in a same pixel row contain RGB pixels repeatedly arranged in a given manner. The first pixels 322 (or second pixels 324) electrically coupled to a same data line, in order, are pixels for displaying different pixels.

Figure 6:
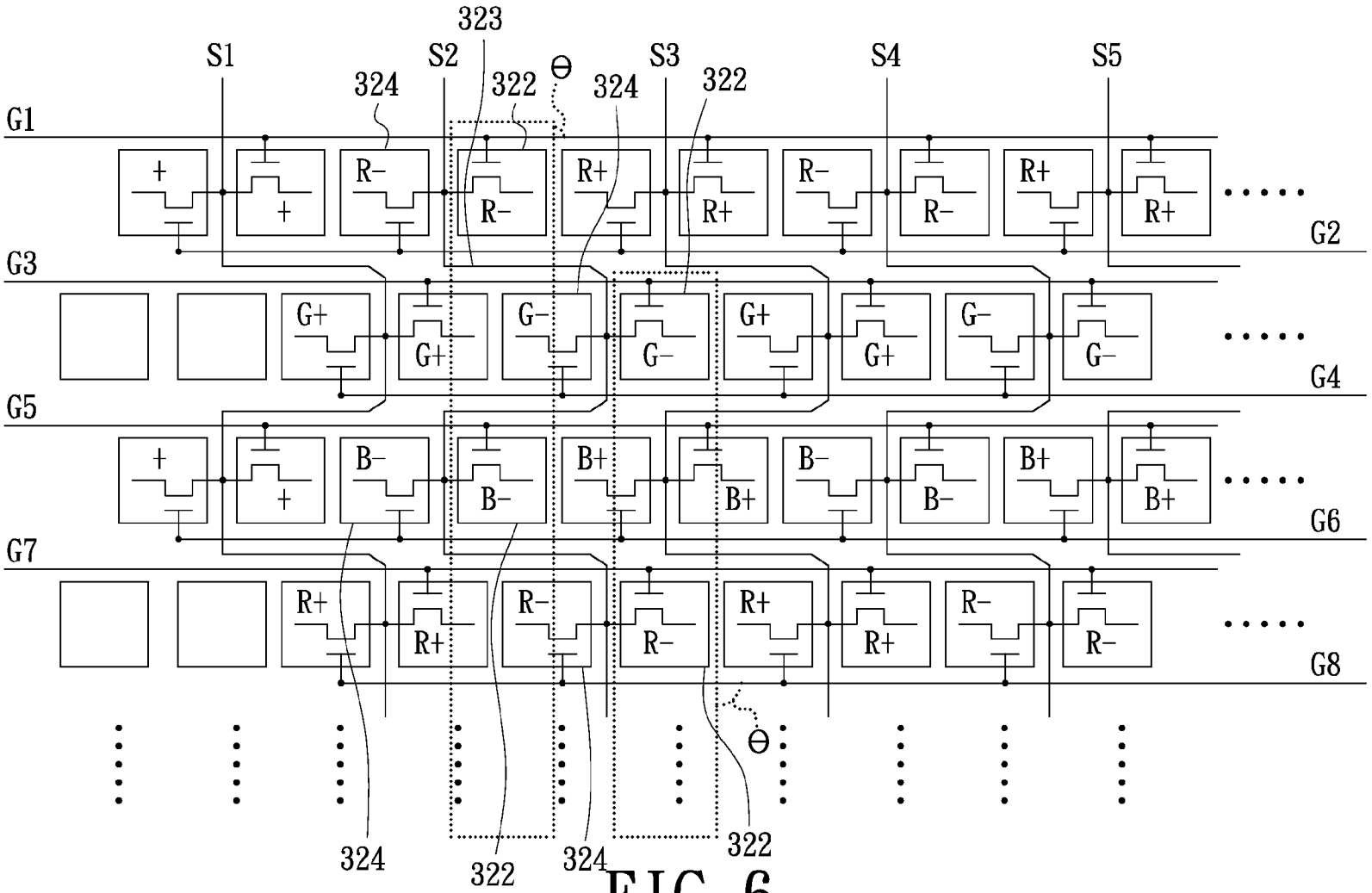
FIG. 6 is a schematic view of a display panel with half source driver structure, in accordance with still another embodiment of the present invention.
Figure 7:
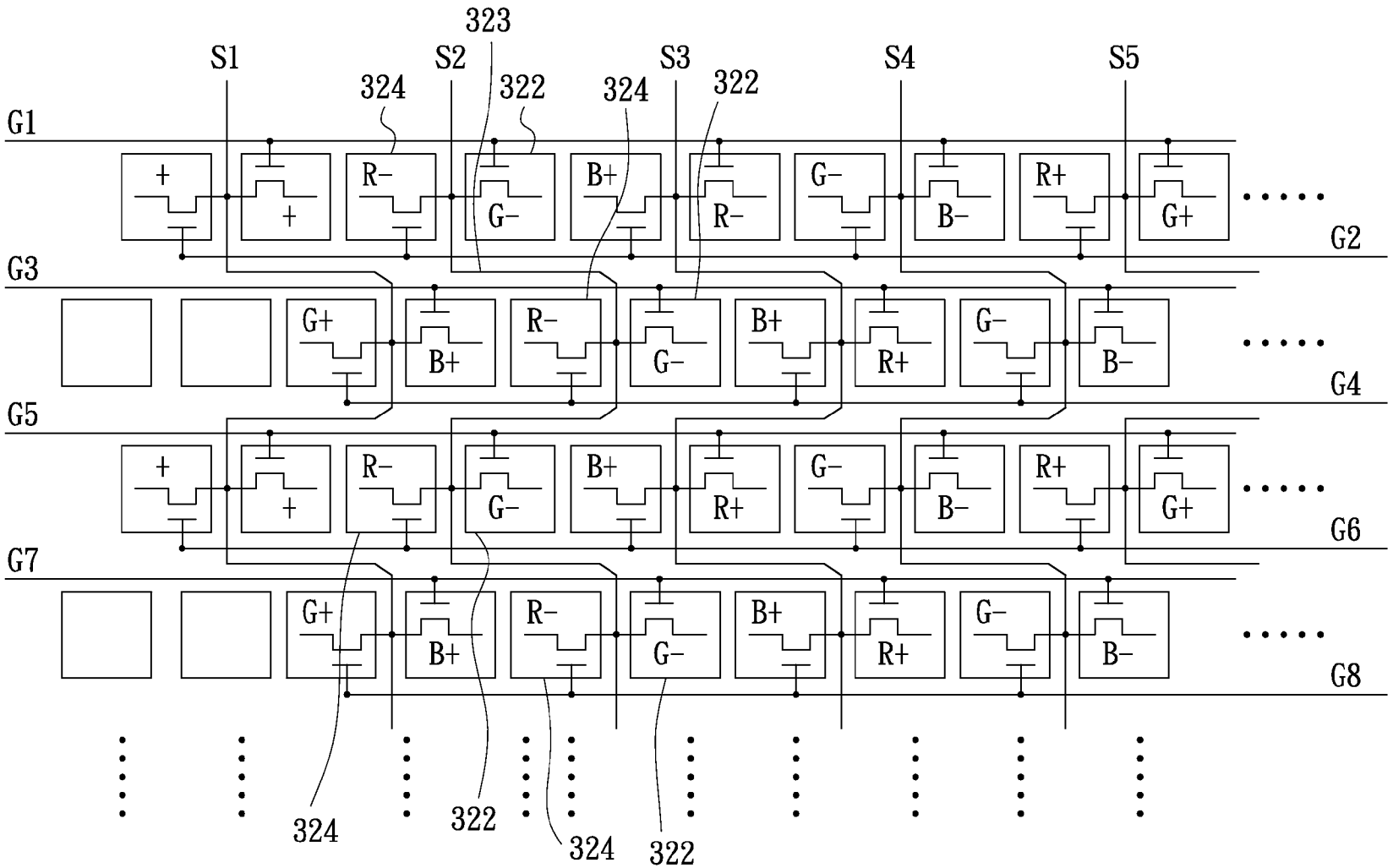
FIG. 7 is a schematic view of a display panel with half source driver structure, in accordance with further still another embodiment of the present invention.

In addition, the RGB pixels in the display panel of the present embodiment are not limited to be arranged in the strip form, and can be arranged in delta form instead as illustrated in FIGS. 6 and 7.

More specifically, for the RGB pixels arranged in delta form as illustrated in FIG. 6, the first pixels 322 (or second pixels 324) in a same pixel row are pixel for displaying a same color. Furthermore, the first pixels 322 (or second pixels 324) electrically coupled to a same data line, in order, are pixels for displaying different colors and arranged in columns to form two lines (as denoted by the dashed rectangles in FIG. 6) intersecting the first gate lines G1, G3, G5 and G7 (or second gate lines G2, G4, G6 and G8) with a particular angle θ (e.g., about 90 degrees).

For the RGB pixels arranged in delta form as illustrated in FIG. 7, the first pixels 322 (or second pixels 324) in a same pixel row contains RGB pixels repeatedly arranged in a given manner. Furthermore, the first pixels 322 (or second pixels 324) electrically coupled to a same data line are pixels for displaying a same color and arranged in columns to form two lines (not shown in FIG. 7) intersecting the first gate lines G1, G3, G5 and G7 (or second gate lines G2, G4, G6 and G8) with a particular angle θ (e.g., about 90 degrees).

In summary, in the above-mentioned embodiments of the present invention, owing to the particular pixels and data line layouts, the dot inversion used in the prior art can be replaced by column inversion and an image display effect of the display panel in accordance with the present invention can be the same as the image display effect of the display panel with dot inversion in the prior art. Furthermore, for the present display panel with column inversion, the polarity of each of the data lines only is inversed one time in every frame image, compared with the prior art that the polarity of each of the data lines is inversed one time in each line period of every frame image, the power consumption of the data lines is greatly reduced.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A display panel with half source driver structure, comprising:

a plurality of gate driving circuits, disposed on the display panel;

a data line, for receiving and transmitting a plurality of display data;

a plurality of first gate lines, for transmitting a first gate driving signal in turn;

a plurality of second gate lines, for transmitting a second gate driving signal in turn;

a plurality of first pixels, electrically connected to the data line and arranged along the data line and forming two spaced pixel columns, the first pixels being disposed one side of the data line and electrically coupled to the respective first gate lines; and a plurality of second pixels, electrically connected to the data line and arranged along the data line and forming another two spaced pixel columns alternately arranged with the two spaced pixel columns, the second pixels being disposed a different side of the data line relative to the first pixels and electrically coupled to the respective second gate lines;

wherein the data line has a bending portion between each two sequentially connected first pixels and traversing two pixels in a same row, a part of the gate driving circuits is/are electrically coupled to the first gate lines and disposed at one side of the data line, and the other part of the gate driving circuits is/are electrically coupled to the second gate lines and disposed at an opposite side of the data line;

wherein the first pixels and the second pixels together are arranged to form a plurality of pixel rows, each of the pixel rows having two dummy pixels disposed at the head or tail thereof;

whereby an image display effect of the display panel driven with column inversion achieves an image display effect of dot inversion.

2. The display panel as claimed in claim 1, wherein the first pixels are alternately formed in the two columns.

3. A display data supplying method of the display panel as claimed in claim 1, comprising:

providing a plurality of the display data with a same polarity in every frame;

transmitting the first gate driving signal and the second gate driving signal; and transmitting the display data with the same polarity, in turn, to one of the first pixels and one of the second pixels.

4. The display data supplying method as claimed in claim 3, further comprising:

providing a plurality of the display data with different polarities in each two adjacent frames.

5. The display panel as claimed in claim 1, wherein the first pixels have a pixel shift in a pixel row direction of the display panel larger than one pixel size.

6. The display panel as claimed in claim 1, whereby the image display effect of dot inversion is an image display effect of two-dot inversion.

7. A display panel with half source driver structure, comprising:

a plurality of gate driver chips, disposed on the display panel;

a data line, for receiving and transmitting a plurality of display data;

a plurality of first gate lines, for transmitting a first gate driving signal in turn;

a plurality of second gate lines, substantially parallel to the first gate lines and for transmitting a second gate driving signal in turn;

a plurality of first pixels, electrically connected to the data line and disposed at one side of the data line and alternately arranged in two spaced pixel columns, each of the first pixels electrically coupled to one of the first gate lines; and a plurality of second pixels, electrically connected to the data line and disposed at a different side of the data line relative to the first pixels, each of the second pixels electrically coupled to one of the second gate lines;

wherein the first pixels are arranged in the two spaced pixel columns to form two lines intersecting the first gate lines with a particular angle, a part of the gate driver chips is/are electrically coupled to the first gate lines and disposed at one side of the data line, and the other part of the gate driver chips is/are electrically coupled to the second gate lines and disposed at an opposite side of the data line;

wherein the two spaced pixel columns are spaced from each other by another pixel column formed by some of the second pixels;

wherein the first pixels and the second pixels together are arranged to form a plurality of pixel rows, each of the pixel rows having two dummy pixels disposed at the head or tail thereof;

whereby an image display effect of the display panel driven with column inversion achieves an image display effect of two-dot inversion.

8. The display panel as claimed in claim 7, wherein the particular angle is about 90 degrees.

9. The display panel as claimed in claim 7, wherein a width of each of the lines is equal to that of the first pixels.

10. A display data supplying method of the display panel as claimed in claim 7, comprising:

providing a plurality of the display data with a same polarity in every frame;

transmitting the first gate driving signal and the second gate driving signal; and transmitting the display data with the same polarity to the first pixels and the second pixels.

11. The display data supplying method as claimed in claim 10, further comprising:

providing a plurality of the display data with different polarities in each two adjacent frames.

12. The display panel as claimed in claim 7, wherein the first pixels have a pixel shift in a pixel row direction of the display panel larger than one pixel size.

* * * * *